US010553418B2

(12) United States Patent
Hoyes et al.

(10) Patent No.: US 10,553,418 B2
(45) **Date of Patent: *Feb. 4, 2020**

(54) SPACE FOCUS TIME OF FLIGHT MASS SPECTROMETER

(71) Applicant: Micromass UK Limited, Wilmslow (GB)

(72) Inventors: John Brian Hoyes, Stockport (GB); David J. Langridge, Macclesfield (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/968,171

(22) Filed: Dec. 14, 2015

(65) Prior Publication Data

US 2016/0104611 A1 Apr. 14, 2016

Related U.S. Application Data

(63) Continuation of application No. 13/996,893, filed as application No. PCT/GB2011/052576 on Dec. 22, 2011, now Pat. No. 9,214,328.

(Continued)

(30) Foreign Application Priority Data

Dec. 23, 2010 (GB) ..... 1021840.2

(51) Int. Cl.
*H01J 49/40* (2006.01)
*H01J 49/00* (2006.01)

(52) U.S. Cl.
CPC ..... *H01J 49/403* (2013.01); *H01J 49/0027* (2013.01); *H01J 49/401* (2013.01)

(58) Field of Classification Search
CPC ..... H01J 49/401; H01J 49/403; H01J 49/405
See application file for complete search history.

(56) References Cited

U.S. PATENT DOCUMENTS 5,464,985 A 11/1995 Cornish et al.
5,814,813 A * 9/1998 Cotter ..... H01J 49/405 250/282

(Continued)

FOREIGN PATENT DOCUMENTS

| | | |
|---|---|---|
| GB | 2481883 | 1/2012 |
| JP | 2002/245964 | 8/2002 |
| JP | 2005/538346 | 12/2005 |

OTHER PUBLICATIONS

Rao et al., 'A time of flight mass spectrometer with field free interaction region for low energy charged particle=molecule collsion studies' Nov. 3, 2011, Rev. Sci. Instrum., 82, 113101.*

(Continued)

*Primary Examiner* — Eliza W Osenbaugh-Stewart

(57) ABSTRACT

A Time of Flight mass spectrometer is disclosed wherein a fifth order spatial focusing device is provided. The device which may comprise an additional stage in the source region of the Time of Flight mass analyser is arranged to introduce a non-zero fifth order spatial focusing term so that the combined effect of first, third and fifth order spatial focusing terms results in a reduction in the spread of ion arrival times ΔT of ions arriving at the ion detector.

3 Claims, 14 Drawing Sheets

Related U.S. Application Data

(60) Provisional application No. 61/432,837, filed on Jan. 14, 2011.

(56) References Cited

U.S. PATENT DOCUMENTS

| | | | | |
|---|---|---|---|---|
| 5,869,829 | A | 2/1999 | Dresch | |
| 6,013,913 | A | 1/2000 | Hanson | |
| 6,384,410 | B1 | 5/2002 | Kawato | |
| 6,518,568 | B1 * | 2/2003 | Kovtoun | H01J 49/40 250/287 |
| 6,621,073 | B1 | 9/2003 | Dresch | |
| 6,627,877 | B1 | 9/2003 | Davis et al. | |
| 7,038,197 | B2 | 5/2006 | Bateman et al. | |
| 7,326,925 | B2 | 2/2008 | Verentchikov et al. | |
| 7,385,187 | B2 | 6/2008 | Verentchikov | |
| 7,667,195 | B2 | 2/2010 | Vestal | |
| 9,214,328 | B2 * | 12/2015 | Hoyes | H01J 49/403 |
| 2004/0232327 | A1 * | 11/2004 | Bateman | H01J 49/401 250/288 |
| 2006/0214100 | A1 * | 9/2006 | Verentchikov | H01J 49/406 250/287 |
| 2006/0255294 | A1 * | 11/2006 | Martin, III | H01J 49/06 250/492.3 |
| 2007/0029473 | A1 * | 2/2007 | Verentchikov | H01J 49/406 250/281 |
| 2008/0272287 | A1 * | 11/2008 | Vestal | H01J 49/40 250/282 |

OTHER PUBLICATIONS

Short et al., "*Improved Energy Compensation for Time-of-Flight Mass Spectrometry*", Journal of the American Society of Mass Spectrometry, vol. 5, No. 8, pp. 779-787.

Wiley et al., "*Time-of-Flight Mass Spectrometer With Improved Resolution*", The Review of Scientific Instruments, vol. 26, No. 12, pp. 1150-1157, 1955.

Boesl et al., "*Reflectron time-of-flight mass spectrometry and laser excitation for the analysis of neutrals, ionized molecules and secondary fragments*", International Journal of Mass Spectrometry and Ion Processes, vol. 112, No. 2-3, pp. 121-166, 1992.

* cited by examiner

Area 1 = Area 2 = Area N

SPACE FOCUS TIME OF FLIGHT MASS SPECTROMETER

CROSS-REFERENCE TO RELATED APPLICATION

This application is a continuation of U.S. patent application Ser. No. 13/996,893 entitled "Space Focus Time of Flight Mass Spectrometer" filed 21 Jun. 2013 which represents a National Stage application of PCT/GB2011/052576 entitled "Improved Space Focus Time of Flight Mass Spectrometer" filed 22 Dec. 2011 which claims priority from and the benefit of U.S. Provisional Patent Application Ser. No. 61/432,837 filed on 14 Jan. 2011 and United Kingdom Patent Application No. 1021840.2 filed on 23 Dec. 2010. The entire contents of these applications are incorporated herein by reference.

BACKGROUND TO THE PRESENT INVENTION

The present invention relates to a mass spectrometer and a method of mass spectrometry.

Wiley and McLaren (Time-of-Flight Mass Spectrometer with Improved Resolution, (Review of Scientific Instruments 26, 1150 (1955), W C Wiley, I H McLaren) set out the basic equations that describe two stage extraction Time of Flight mass spectrometers. The principles apply equally to continuous axial extraction Time of Flight mass analysers and orthogonal acceleration Time of Flight mass analysers and time lag focussing instruments.

FIG. 1 shows the principle of second order spatial (or space) focussing wherein ions with an initial spatial distribution are brought to a focus at the plane of an ion detector thereby improving instrumental resolution.

An ion beam with initial energy ΔVo and with no initial position deviation has a time of flight in the first acceleration stage $L_p$ (called the "pusher" in an orthogonal acceleration Time of Flight instrument) given by:

$$t = \frac{1}{a}\sqrt{\frac{2q}{m}} \cdot [(V_p \pm \Delta Vo)^{1/2} \pm \Delta Vo^{1/2}] \tag{1}$$

wherein ions of mass m and charge q are accelerated at a rate a through a potential Vp.

The initial velocity vo is related to the initial energy ΔVo by the relation:

$$vo = \sqrt{\frac{2 \cdot \Delta Vo}{m}} \tag{2}$$

The second term in the square brackets of Eqn. 1 is referred to as the "turnaround time" which is a major limiting aberration in Time of Flight instruments. The concept of turn around time is illustrated in FIG. 2. Ions that start at the same position but with equal and opposite velocities will have identical energies in the flight tube given by:

$$K \cdot E = qVacc + \frac{1}{2}mv^2 \tag{3}$$

However, the ions will be separated by a turnaround time Δt which is smaller for steeper acceleration fields i.e. Δt2<Δt1. This is often the major limiting aberration in Time of Flight instrument design and instrument designers go to great lengths to minimise this term.

The most common approach to minimising this aberration is to accelerate the ions as forcefully as possible i.e. the acceleration term a is made as large as possible by maximising the electric field i.e. the ratio Vp/Lp. This is normally achieved by making the pusher voltage Vp large and the acceleration stage length Lp short. However, this approach has a practical limit for a two stage geometry as the Wiley McLaren type spatial focussing solution leads to shorter physical instruments which will have very short flight times as shown in FIG. 3. Very short flight times would require ultra fast high bandwidth detection systems which are impracticable.

A known solution to this problem is to add a reflectron wherein the first position of spatial focus is re-imaged at the ion detector as shown in FIG. 4. This leads to longer practical flight time instruments which are capable of relatively high resolution.

In conventional reflection Time of Flight instruments the reflectron may comprise either a single stage reflectron or a two stage reflectron whilst in both reflectron and non-reflection Time of Flight instruments the extraction region usually comprises a two stage Wiley/McLaren source. Usually within these geometries the objective is to achieve perfect first or second order space focusing or to re-introduce a small first order term to further improve space focusing.

It is known that a small first order term may be arranged to compensate for linear pre-extraction velocity-position correlations obtained in various ion transfer configurations.

Despite known approaches to space focusing, the practical performance of known Time of Flight instruments is limited by space focusing characteristics. These limitations are most evident in the relationship between resolution and sensitivity.

It is desired to provide an improved Time of Flight mass spectrometer.

SUMMARY OF THE INVENTION

According to an aspect of the present invention there is provided a mass spectrometer comprising:

a Time of Flight mass analyser comprising a source region and an ion detector;

wherein, in use, ions arriving at the ion detector have a spread of ion arrival times ΔT which is related to an initial spread of positions Δx of the ions within the source region by a polynomial expression of the form $\Delta T = a_0 + a_1(\Delta x)T' + a_2(\Delta x)^2T'' + a_3(\Delta x)^3T''' + \ldots$ wherein $a_1(\Delta x)T'$ is a first order spatial focusing term, $a_2(\Delta x)^2T''$ is a second order spatial focusing term, $a_3(\Delta x)^3T'''$ is a third order spatial focusing term and T is the mean time of flight of ions having a certain mass to charge ratio;

wherein:

the Time of Flight mass analyser further comprises a fifth order spatial focusing device which is arranged and adapted to introduce a non-zero fifth order spatial focusing term so that the combined effect of the first and/or third and/or fifth order spatial focusing terms is a reduction in the spread of ion arrival times ΔT.

According to a preferred embodiment of the present invention a fifth order spatial focusing term is introduced which preferably offsets the effects of a non-zero third order spatial focusing term. The spread of ion arrival times at the ion detector is significantly reduced according to the preferred embodiment which improves the resolution of the mass spectrometer.

According to an aspect of the present invention there is provided a mass spectrometer comprising:

a Time of Flight mass analyser comprising a source region and an ion detector; wherein, in use, ions arriving at the ion detector have a spread of ion arrival times $\Delta T$ which is related to an initial spread of positions $\Delta x$ of the ions within the source region by a polynomial expression of the form $\Delta T=a_0+a_1(\Delta x)T'+a_2(\Delta x)^2T''+a_3(\Delta x)^3T'''+\ldots$ wherein $a_1(\Delta x)T'$ is a first order spatial focusing term, $a_2(\Delta x)^2T''$ is a second order spatial focusing term, $a_3(\Delta x)^3T'''$ is a third order spatial focusing term and T is the mean time of flight of ions having a certain mass to charge ratio;

wherein:

the Time of Flight mass analyser further comprises a fourth order spatial focusing device which is arranged and adapted to introduce a non-zero fourth order spatial focusing term so that the combined effect of the second and fourth order spatial focusing terms is a reduction in the spread of ion arrival times $\Delta T$.

According to a less preferred embodiment of the present invention a fourth order spatial focusing term is introduced which preferably offsets the effects of a non-zero second order spatial focusing term. The spread of ion arrival times at the ion detector is significantly reduced according to the preferred embodiment which improves the resolution of the mass spectrometer.

The source region preferably comprises an extraction stage and a first acceleration stage and wherein the fourth order spatial focusing device and/or the fifth order spatial focusing device preferably comprise a third stage in the source region, the third stage comprising either: (i) a second acceleration stage; (ii) a deceleration stage; or (iii) a field free region.

The third stage in the source region is preferably pulsed, in use, in synchronism with the extraction stage.

The Time of Flight mass analyser preferably further comprises a reflectron having a first deceleration or acceleration stage and a second deceleration or acceleration stage.

The fourth order spatial focusing device and/or the fifth order spatial focusing device preferably comprise a third deceleration or acceleration stage provided within the reflectron.

According to an embodiment a first electric field gradient E1 is maintained across the first deceleration or acceleration stage, a second electric field gradient E2 is maintained across the second deceleration or acceleration stage and a third electric field gradient E3 is maintained across the third deceleration or acceleration stage. According to an embodiment $E1\neq E2\neq E3$.

The reflectron preferably comprises a multi-pass reflectron i.e. ions are reflected back in a direction towards the ion detector more than once. According to an embodiment the ions follow a W-shaped path through the drift region from the source region to the ion detector.

The Time of Flight mass analyser preferably further comprises a drift region intermediate the source region and the reflectron, wherein the fourth order spatial focusing device and/or the fifth order spatial focusing device preferably comprise a deceleration or acceleration stage provided in the drift region.

The mass spectrometer preferably further comprises a device arranged and adapted to introduce a first order spatial focusing term to compensate for ions having an initial spread of velocities.

The mass spectrometer preferably further comprises a device arranged and adapted to introduce a first order spatial focusing term to improve spatial focussing.

The mass spectrometer preferably further comprises a beam expander arranged upstream of the source region, the beam expander being arranged and adapted to reduce an initial spread of velocities of ions arriving in the source region.

The fourth order spatial focusing device and/or the fifth order spatial focusing device are preferably arranged and adapted so that the spread of ion arrival times $\Delta T$ in nanoseconds as a function of the initial spread of positions $\Delta x$ in millimetres is selected from the group consisting of: (i) <0.1 ns; (ii) <0.9 ns; (iii) <0.8 ns; (iv) <0.7 ns; (v) <0.6 ns; (vi) <0.5 ns; (vii) <0.4 ns; (viii) <0.3 ns; (ix) <0.2 ns; (x) <0.1 ns.

The Time of Flight mass analyser preferably comprises a linear Time of Flight mass analyser or an orthogonal acceleration Time of Flight mass analyser.

The Time of Flight mass analyser preferably comprises a multi-pass Time of Flight mass analyser.

According to an aspect of the present invention there is provided a method of mass spectrometry comprising:

providing a Time of Flight mass analyser comprising a source region and an ion detector;

wherein ions arriving at the ion detector have a spread of ion arrival times $\Delta T$ which is related to an initial spread of positions $\Delta x$ of the ions within the source region by a polynomial expression of the form $\Delta T=a_0+a_1(\Delta x)T'+a_2(\Delta x)^2T''+a_3(\Delta x)^3T'''+\ldots$ wherein $a_1(\Delta x)T'$ is a first order spatial focusing term, $a_2(\Delta x)^2T''$ is a second order spatial focusing term, $a_3(\Delta x)^3T'''$ is a third order spatial focusing term and T is the mean time of flight of ions having a certain mass to charge ratio;

wherein:

the method further comprises introducing a non-zero fifth order spatial focusing term so that the combined effect of the first and/or third and/or fifth order spatial focusing terms is a reduction in the spread of ion arrival times $\Delta T$.

According to an aspect of the present invention there is provided a method of mass spectrometry comprising:

providing a Time of Flight mass analyser comprising a source region and an ion detector;

wherein ions arriving at the ion detector have a spread of ion arrival times $\Delta T$ which is related to an initial spread of positions $\Delta x$ of the ions within the source region by a polynomial expression of the form $\Delta T=a_0+a_1(\Delta x)T'+a_2(\Delta x)^2T''+a_3(\Delta x)^3T'''+\ldots$ wherein $a_1(\Delta x)T'$ is a first order spatial focusing term, $a_2(\Delta x)^2T''$ is a second order spatial focusing term, $a_3(\Delta x)^3T'''$ is a third order spatial focusing term and T is the mean time of flight of ions having a certain mass to charge ratio;

wherein:

the method further comprises introducing a non-zero fourth order spatial focusing term so that the combined effect of the second and fourth order spatial focusing terms is a reduction in the spread of ion arrival times $\Delta T$.

The preferred embodiment is concerned with the deterministic introduction of higher order space focusing aberrations which aid the ultimate space focusing achieved resulting in improved resolution and/or sensitivity.

The mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source.

The mass spectrometer preferably further comprises one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer may further comprise a stacked ring ion guide comprising a plurality of electrodes having an aperture through which ions are transmitted in use and wherein the spacing of the electrodes increases along the length of the ion path. The apertures in the electrodes in an upstream section of the ion guide may have a first diameter and the apertures in the electrodes in a downstream section of the ion guide may have a second diameter which is smaller than the first diameter. Opposite phases of an AC or RF voltage are preferably applied to successive electrodes.

BRIEF DESCRIPTION OF THE DRAWINGS

Various embodiments of the present invention will now be described, by way of example only, together with other arrangements given for illustrative purposes only and with reference to the accompanying drawings in which.

DETAILED DESCRIPTION OF THE PREFERRED EMBODIMENTS

A preferred embodiment of the present invention will now be described.

If Eqn. 1 is rewritten in terms of velocity vo then this leads to a relationship for the turnaround time t' such that:

$$t' = \frac{Lp \cdot mv}{qVp} \tag{4}$$

The term my is the momentum of the ion beam and the region length Lp is inherently related linearly to the extent of the beam in the pusher.

A fundamental theorem in ion optics is "Liouville's theorem" which states that: "For a cloud of moving particles, the particle density $p(x, p_x, y, p_y, z, p_z)$ in phase space is invariable" (Geometrical Charged-Particle Optics, Harald H. Rose, Springer Series in Optical Sciences 142) where $p_x$, $p_y$ and $p_z$ are the momenta of the three Cartesian coordinate directions.

According to Liouville's theorem a cloud of particles at a time $t_1$ that fills a certain volume in phase space may change its shape at a later time $t_n$ but not the magnitude of its volume. Attempts to reduce this volume by the use of electromagnetic fields will be futile although it is possible to sample desired regions of phase space by aperturing the beam (rejecting unfocusable ions) before subsequent manipulation. A first order approximation splits Liouville's theorem into the three independent space coordinates x, y and z. The ion beam can now be described in terms of three independent phase space areas the shape of which change as the ion beam progresses through an ion optical system but not the total area itself.

Figure 1:
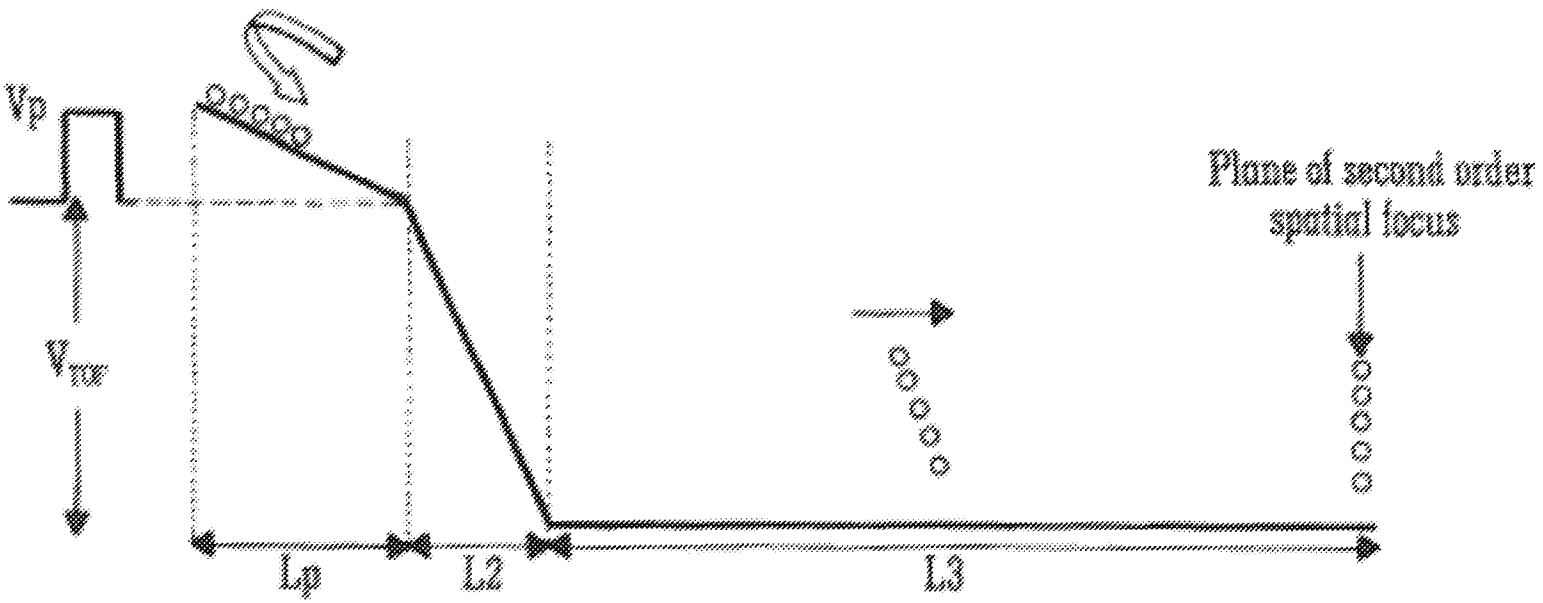
FIG. 1 (PRIOR ART)
FIG. 1 shows a conventional Wiley & McLaren two stage source Time of Flight geometry.
Figure 2:
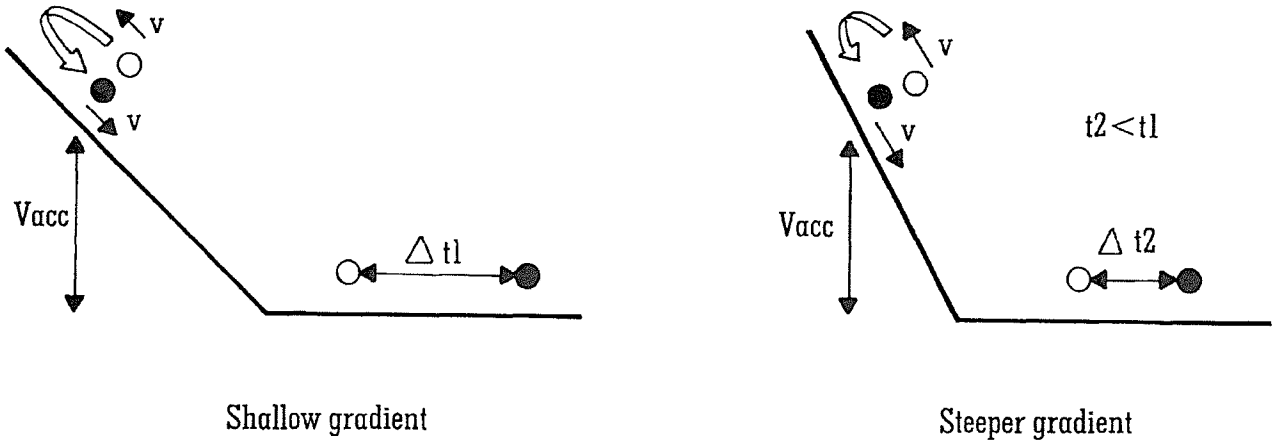
FIG. 2 illustrates the concept of turnaround time.
Figure 3:
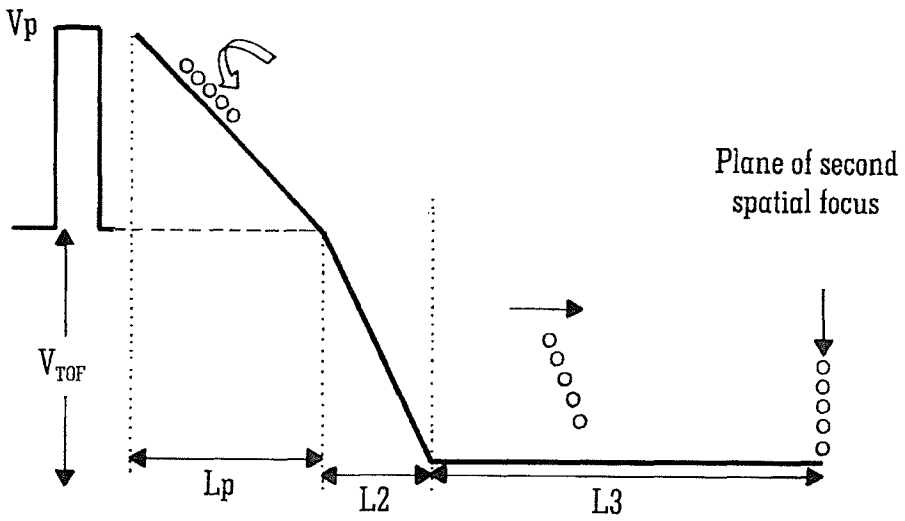
FIG. 3 shows how high initial extraction fields in a two stage source of a Time of Flight mass analyser lead to shorter analysers which are impracticable.
Figure 4:
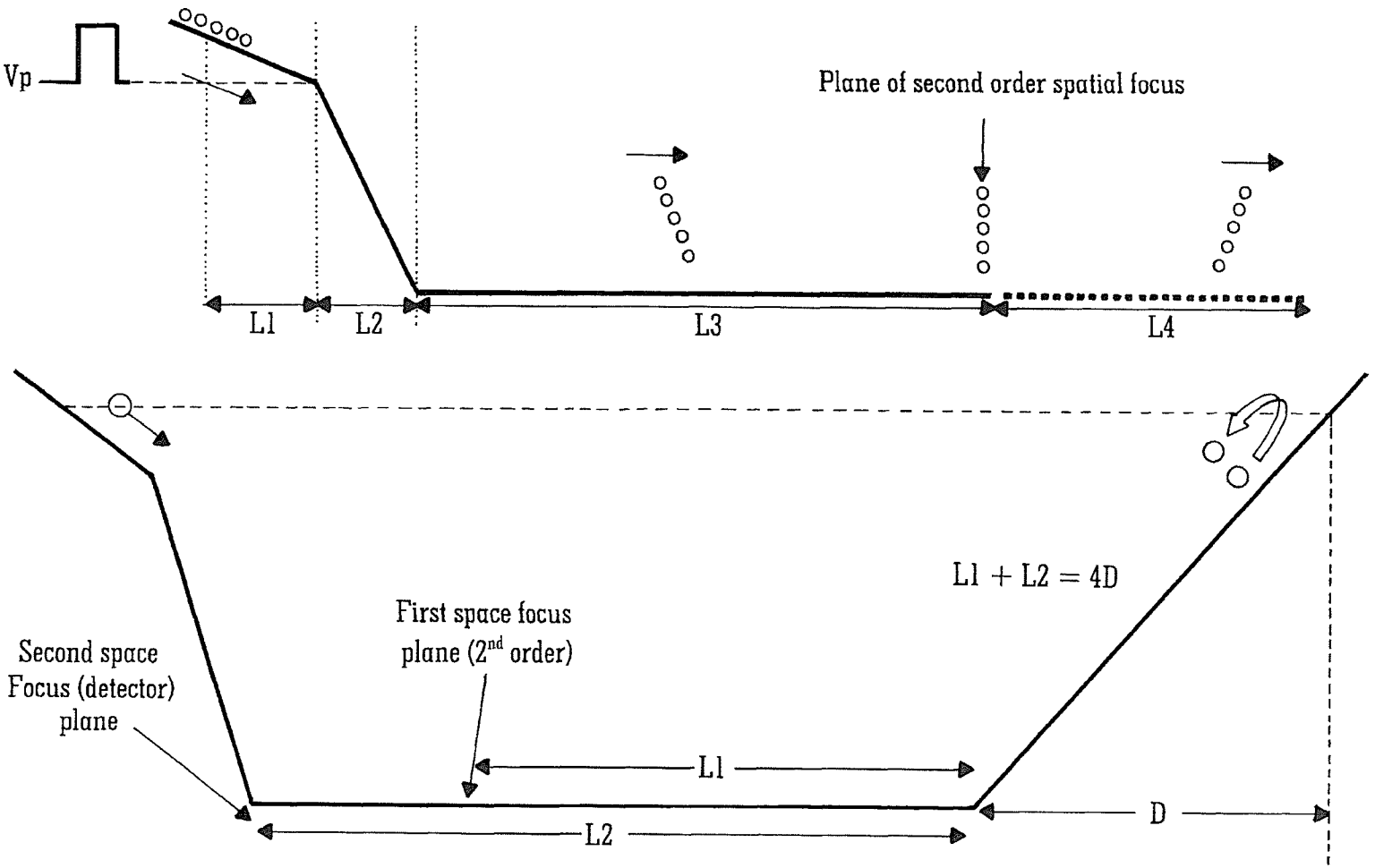
FIG. 4 shows how the addition of a one stage reflectron in an orthogonal acceleration Time of Flight mass analyser allows the combination of high extraction fields and longer flight times.
Figure 5:
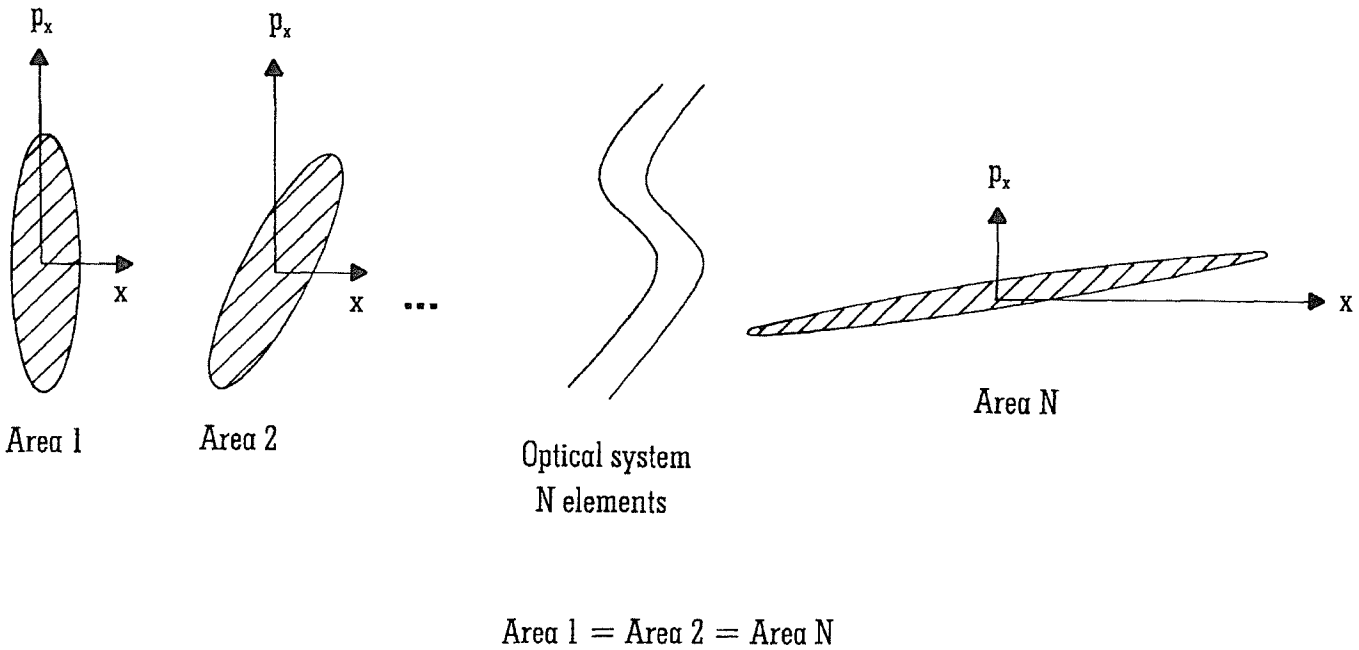
FIG. 5 illustrates Liouvilles's theorem and shows an optical system comprising N optical elements with each element changing the shape of the phase space but not its area.

This concept is illustrated in FIG. 5 which shows an optical system comprising N optical elements with each element changing the shape of the phase space but not its area. Conservation of phase space means that the $\Delta x\ p_x$ term will be constant and so expanding the beam will lead to lower velocity spreads. This is because the $\Delta x\ p_x$ is proportional to the Lp*mv term in Eqn. 4. These lower velocity spreads can ultimately lead to a proportionally lower turnaround times for a fixed extraction field.

Accordingly, an orthogonal acceleration Time of Flight mass spectrometer with the ability to spatially focus larger positional spreads $\Delta x$ will result in a reduced turnaround time and hence higher resolution if the beam is further expanded prior to the extraction region and the field in the extraction region remains constant. Alternatively, if the beam is clipped by an aperture prior to the extraction region then the aperture size can be increased resulting in improved transmission and sensitivity for the same resolution if the beam undergoes no further expansion.

Figure 6A:
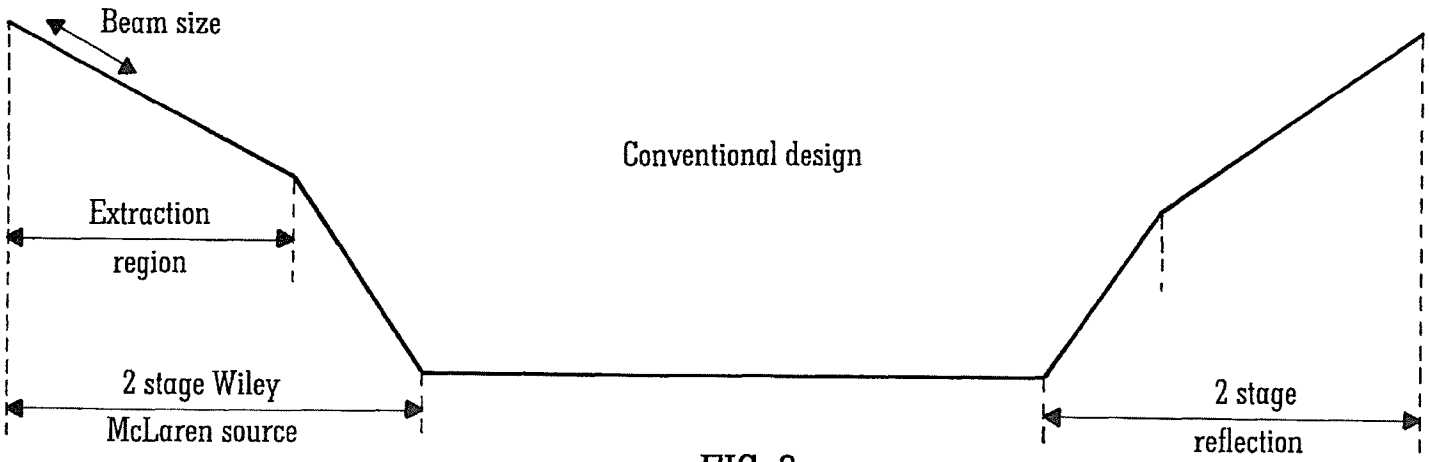
FIG. 6A shows a conventional Time of Flight mass analyser having a two stage source geometry and a two stage reflectron and FIG. 6B shows an embodiment of the present invention comprising a Time of Flight mass analyser comprising a three-stage source.

FIG. 6A shows a conventional Time of Flight geometry comprising a two stage Wiley/McLaren source, an intermediate field free region and a two stage reflectron.

Figure 7A:
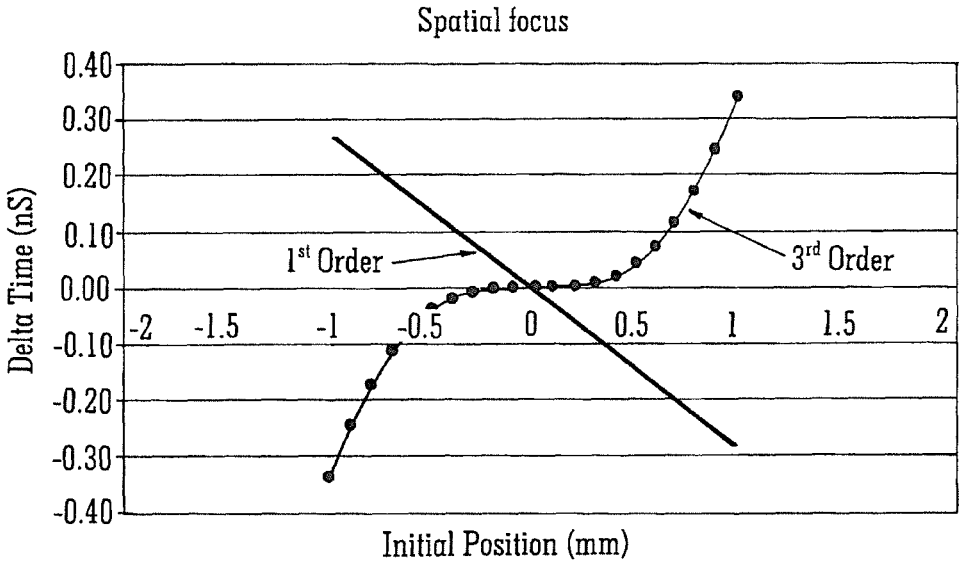
FIG. 7A shows the space focusing characteristics of a conventional Time of Flight mass analyser having a two stage source and two stage reflectron and FIG. 7B shows the corresponding residuals.
Figure 7B:
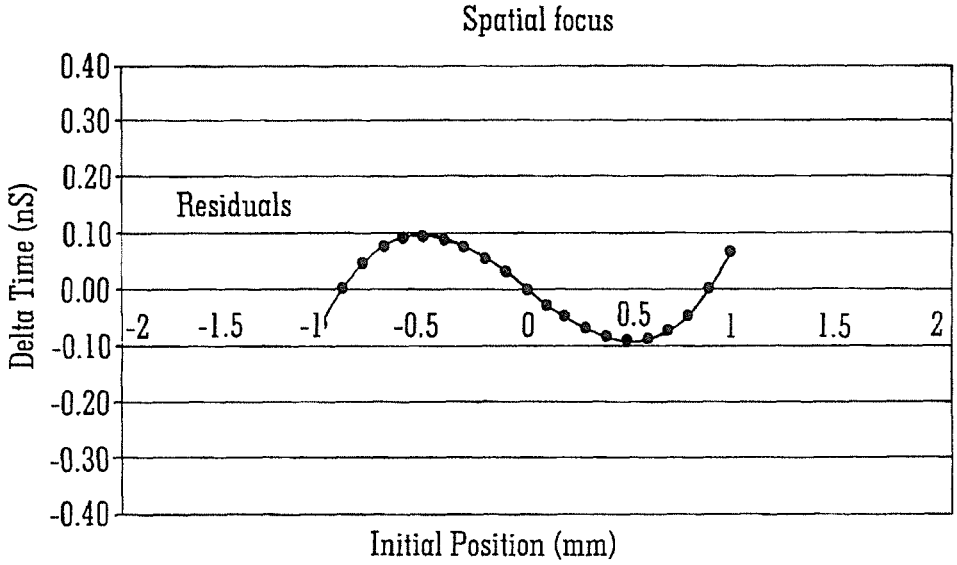

A typical space focusing approach for conventional Time of Flight mass analyser as shown in FIG. 6A is illustrated in FIGS. 7A and 7B. The geometry is configured to provide second order focusing together with an opposing first order term as illustrated in FIG. 7A. The resulting residuals have a lower absolute time spread than either the third order or first order terms individually (FIG. 7B).

Figure 6B:
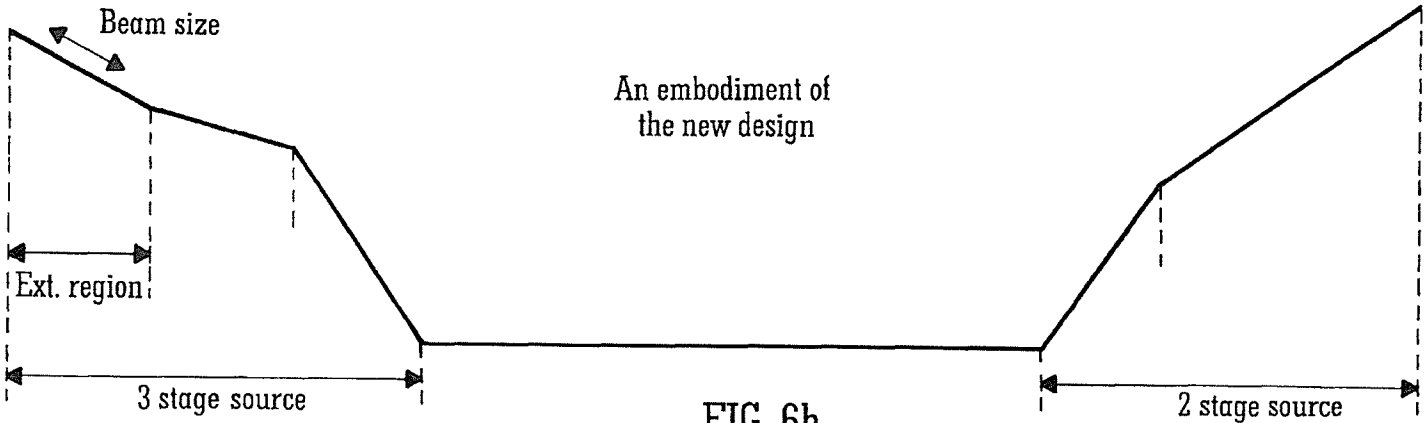
Figure 8A:
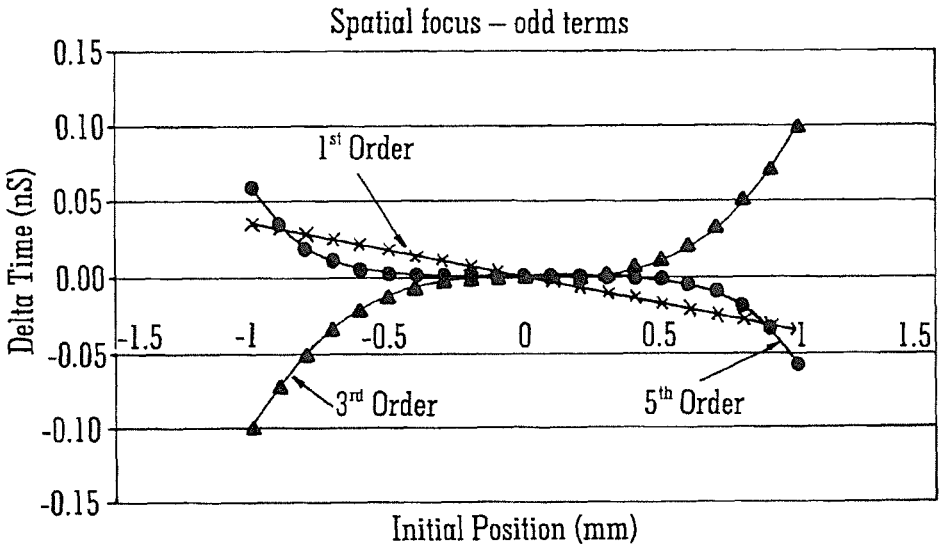
FIG. 8A shows the odd terms of space focusing characteristics of a Time of Flight mass analyser according to a preferred embodiment comprising a three stage source and a two stage reflectron.
Figure 8B:
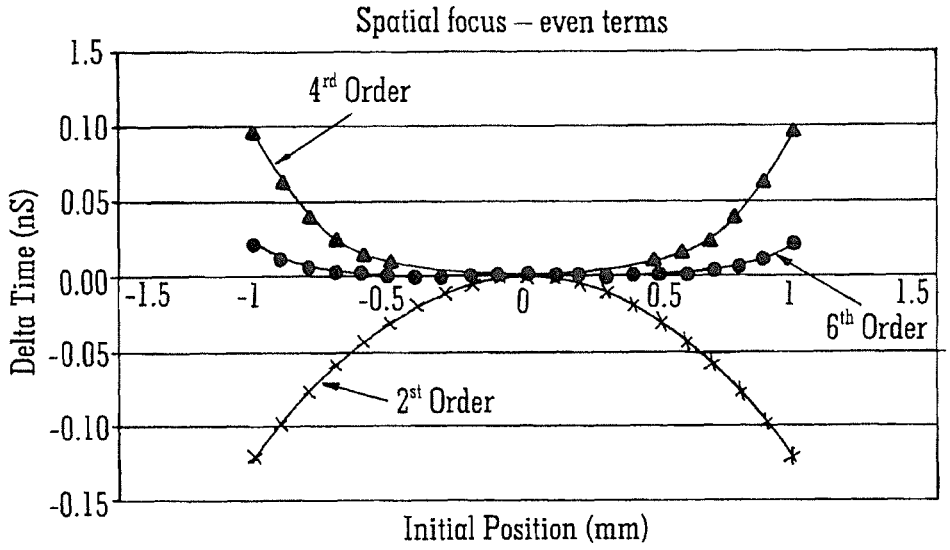
FIG. 8B shows the even terms of the space focusing characteristics of a Time of Flight mass analyser according to the preferred embodiment and FIG. 8C shows the corresponding residuals.

FIG. 6B shows a preferred embodiment of the present invention wherein the known two stage Wiley/McLaren source has been replaced by a three stage source. The first stage of the source has the same extraction field as the extraction region of the known two stage Wiley/McLaren source as shown in FIG. 6A. According to the preferred embodiment the geometry is preferably configured to introduce higher order space focusing terms. These higher order space focusing terms are preferably arranged such that the odd powers (see FIG. 8A) combine to minimise the overall residuals and also so that even powers (see FIG. 8B) will also combine to minimise the overall residuals. The combined residuals are plotted in FIG. 8C on the same scale as FIG. 7B and illustrate how according to the preferred embodiment substantially improved space focusing may be obtained.

Figure 8C:
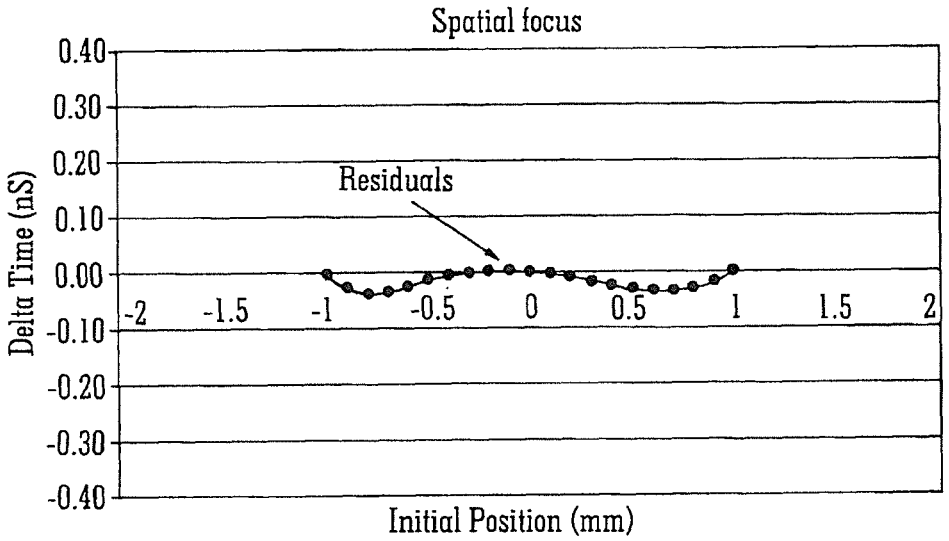
Figure 9:
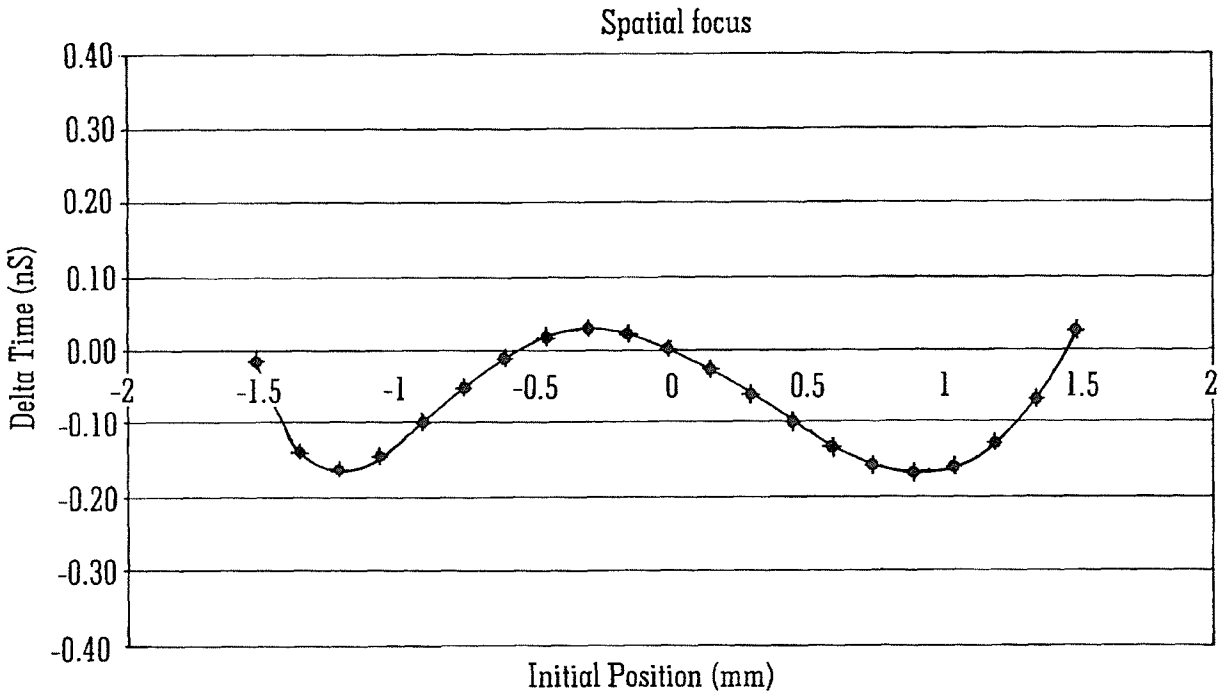
FIG. 9 shows the space focusing residual aberrations for a larger beam according to an embodiment of the present invention comprising a three stage source and a two stage reflectron.

The improved space focus according to the preferred embodiment and as illustrated by FIG. 8C allows expansion of the beam as shown in FIG. 9. In FIG. 9 the ion beam width is scaled by a factor of 1.5 when compared with FIG. 7B yet the absolute time spreads are comparable. According to an embodiment the ions in the wider beam have a reduced spread of velocities which enables the spread in ion arrival times at the ion detector to be reduced thereby improving resolution.

A simulation was performed which compared the two different geometries shown in FIGS. 6A and FIG. 6B. The improvement in resolution according to the preferred embodiment is illustrated in FIG. 10.

Figure 10:
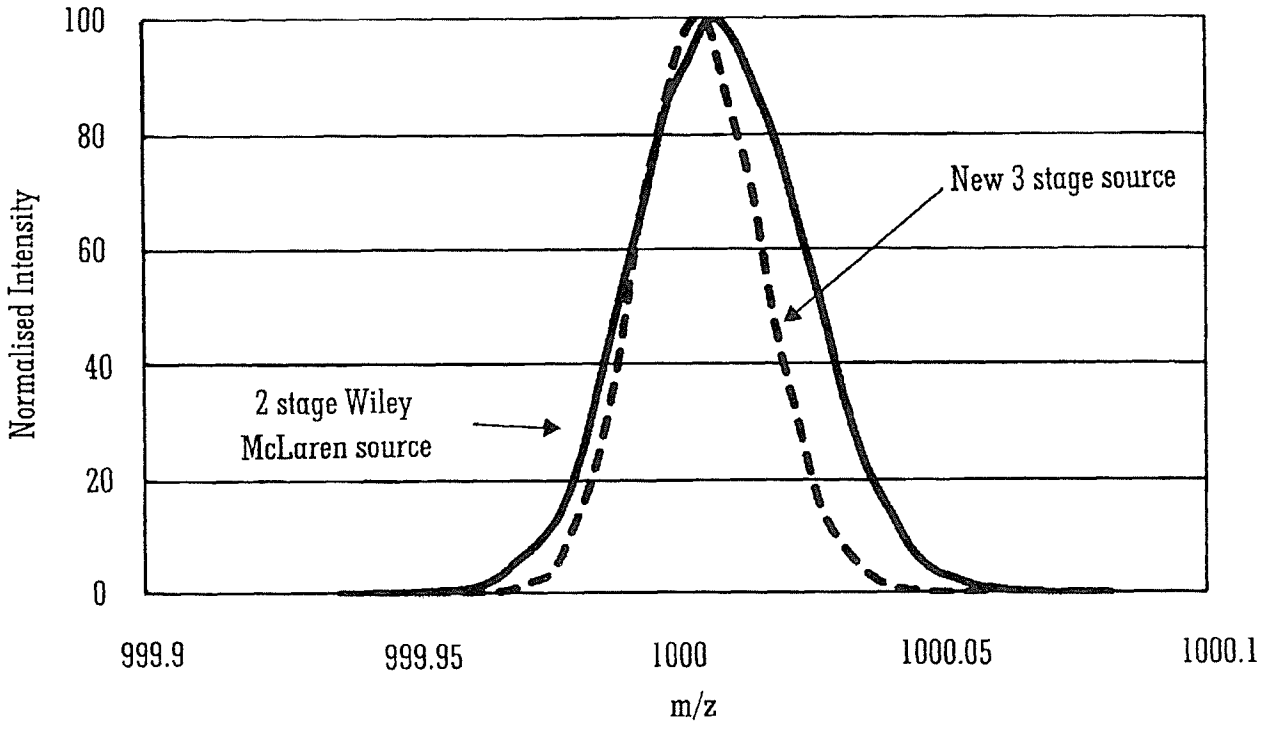
FIG. 10 illustrates the resolution enhancement which may be achieved according to the preferred embodiment.

The dashed line peak shown in FIG. 10 shows the enhanced resolution obtained according to the preferred embodiment and corresponds to the preferred three stage source which receives a ×1.5 wider ion beam having a proportionally lower velocity spread. The resolution enhancement is compared with that obtained conventional as represented by the solid line peak. The vertical scale is normalised for comparison purposes but in reality the area of the two peaks is the same.

The initial conditions of an ion beam in the simulation were defined by a stacked ring RF ion guide ("SRIG") in the presence of a buffer gas. The ions typically adopt a Maxwellian distribution of velocities on exit from the RF element due to the thermal motion of gas molecules with a beam cross section of 1-2 mm.

Simulations of the velocity spreads were performed using SIMION® and a hard sphere model. The hard sphere model simulated collisions with residual gas molecules in the stacked ring RF ion guide. These ion conditions were then used as the input beam parameters for the different geometry types.

Figure 11:
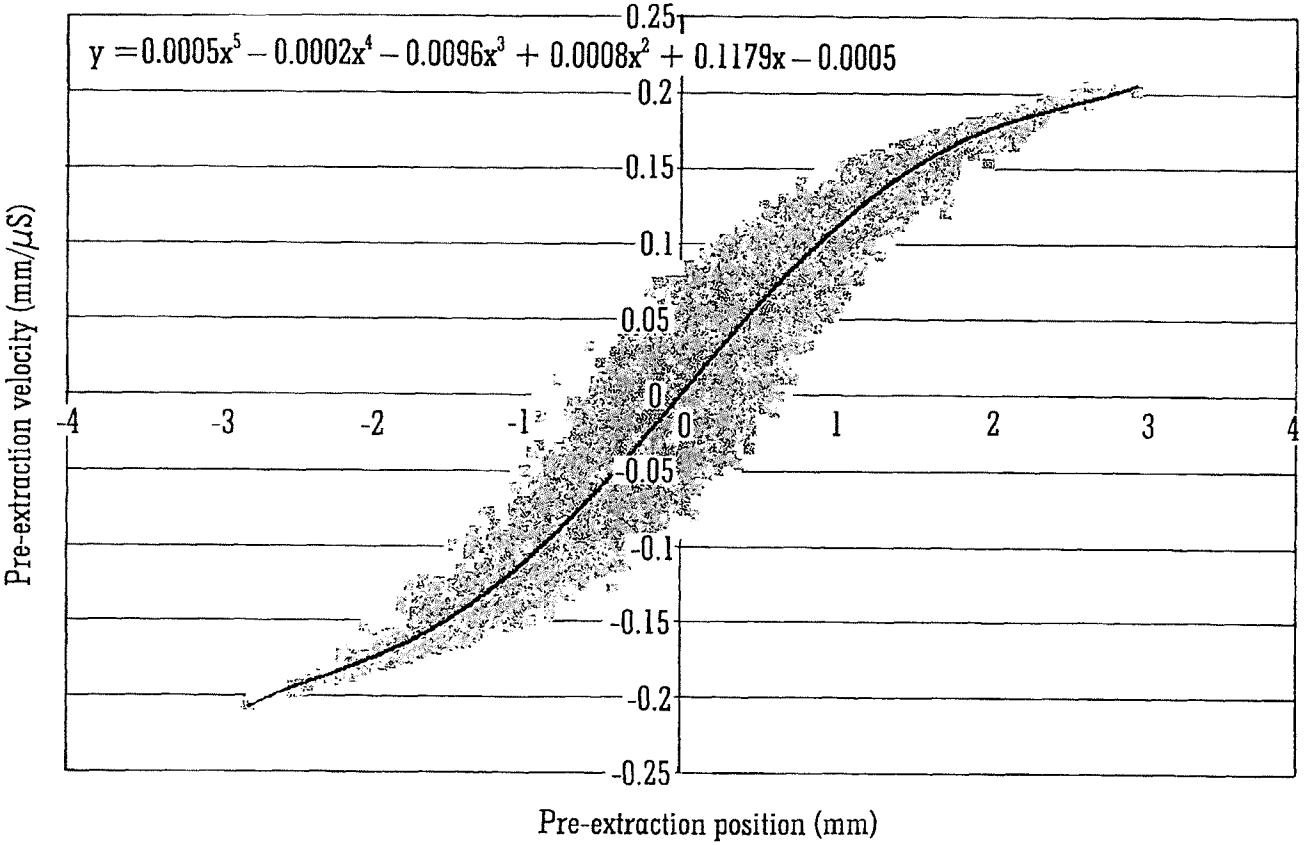
FIG. 11 illustrates higher order correlation for pre-extraction velocity-position (phase space).

Using a similar principle to that used for the correction of linear (first order) velocity-position correlations, it is also possible to arrange the pre-extraction phase space so as to include non linear ($>1^{st}$ order) odd power terms as shown in FIG. 11. These higher order terms can be used to compensate for the higher order odd powered space focus terms further reducing the absolute time spread.

Figure 12:
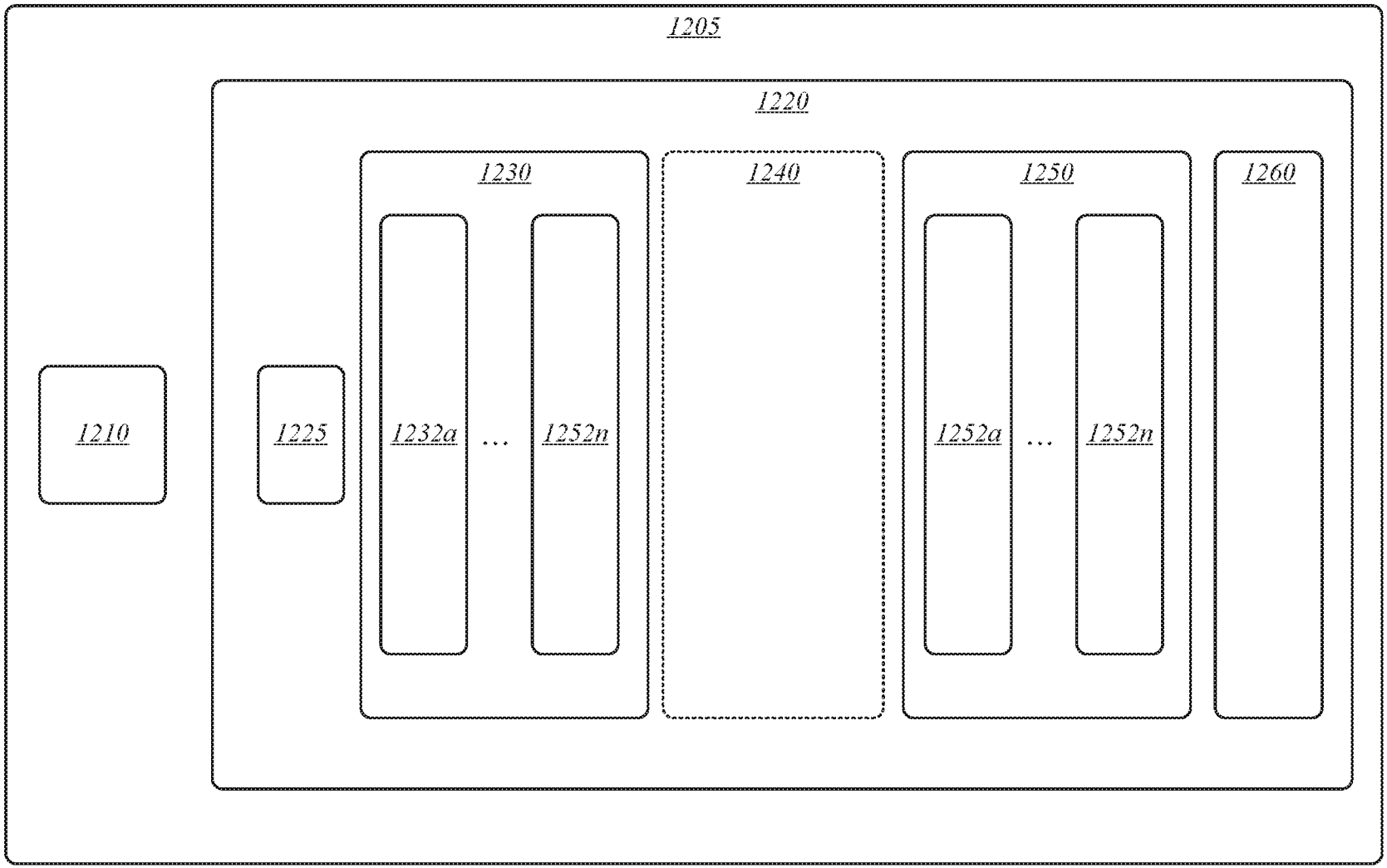
FIG. 12 illustrates a mass spectrometer according to some embodiments.

FIG. 12 illustrates a mass spectrometer according to some embodiments. As shown in FIG. 12, a mass spectrometer 1205 may include an ion source 1210 operative to provide ions to a mass analyser 1220, such as a Time of Flight mass analyser. A source region 1230 may include one or more stages 1232*a-n*, such as an extraction stage and a first acceleration stage. In some embodiments, a beam expander 1225 may be arranged upstream from the source region 1230. A drift region 1240 may be arranged between the source region 1230 and an ion detector 1260. In some embodiments, the mass spectrometer 1205 may include a reflectron 1250 having one or more stages 1252*a-n*, such as a first deceleration or acceleration stage and a second deceleration or acceleration stage.

Although the preferred embodiment relates to providing a third or further stage in the source region of the Time of Flight mass analyser, other embodiments are also contemplated wherein an additional acceleration or deceleration region may be provided within the intermediate field free region between the source and the reflectron. Other embodiments are also contemplated wherein an additional acceleration, deceleration or field free region may be provided with the reflectron. Embodiments are contemplated wherein one or more additional regions are provided within the source and/or field free region and/or reflectron.

Although the preferred embodiment is primarily concerned with a device arranged and adapted to introduce a fourth and/or fifth order spatial focusing term, further embodiments are contemplated wherein a sixth and/or seventh and/or eighth and/or ninth and/or higher order spatial focusing term may be introduced.

Figure 13:
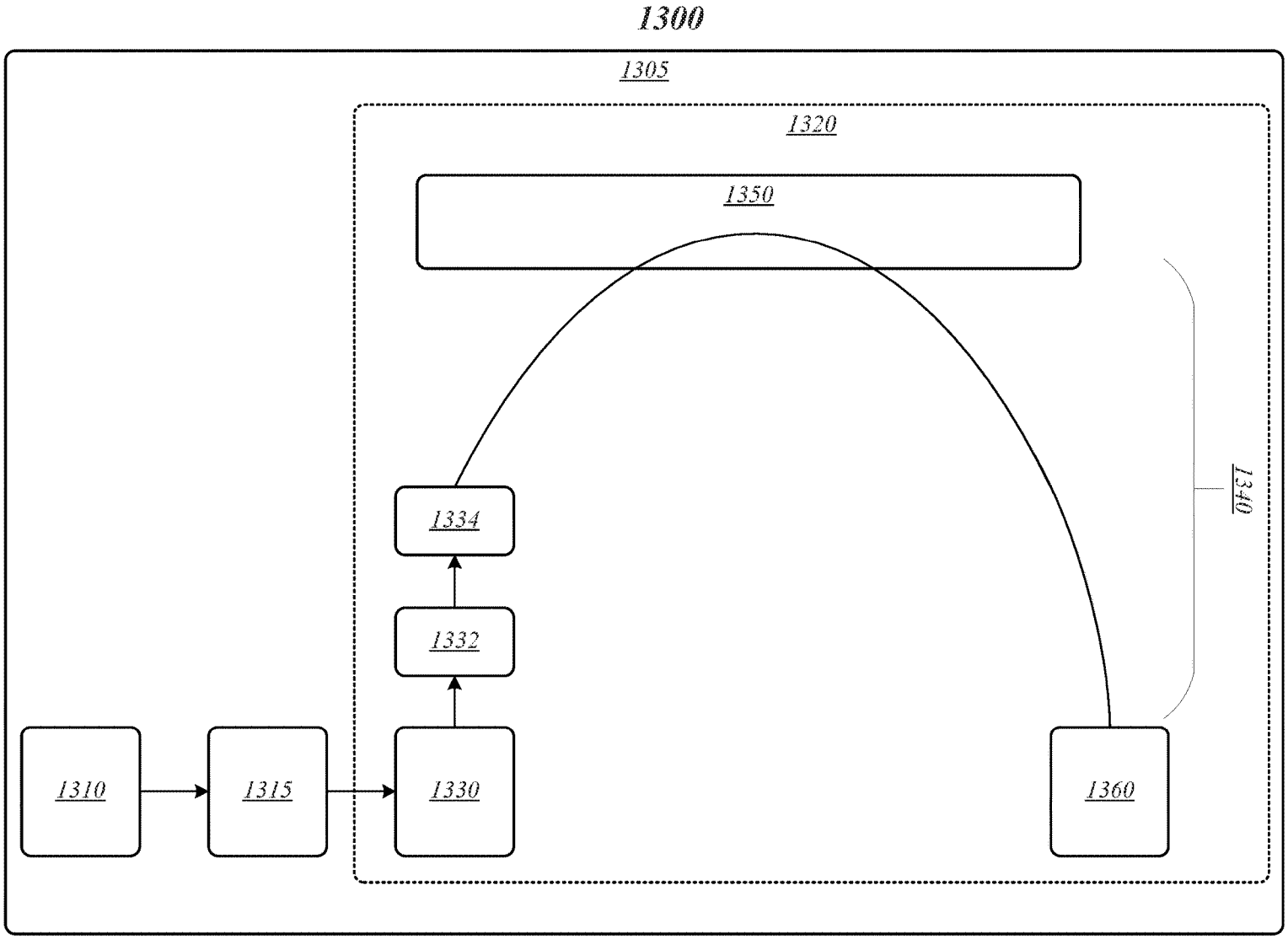
FIG. 13 depicts an operating environment according to some embodiments.

FIG. 13 depicts an operating environment according to some embodiments. As shown in FIG. 13, operating environment may include a mass spectrometer 1305 having an ion source 1310, an optional beam expander 1315, an extraction stage 1330. Mass spectrometer 1305 may be operative to facilitate the passage of ions orthogonally into a field free region 1332 and then into a first acceleration stage 1334 where the ions are accelerated through drift region 1340 towards a reflectron 1350 which may cause the ions to turn around so that they then reach detector 1360.

Although the present invention has been described with reference to preferred embodiments it will be apparent to those skilled in the art that various changes in form and detail may be made without departing from the scope of the invention as defined by the accompanying claims.

The invention claimed is:

1. A mass spectrometer comprising:

an ion source for generating ions; and an orthogonal acceleration Time of Flight mass analyser located downstream of the ion source for analyzing ions generated thereby, the Time of Flight mass analyser comprising a source region, an ion detector, and a drift region disposed between said source region and said ion detector wherein ions separate according to their time of flight as they travel through said drift region;

the Time of Flight mass analyser source region comprising an extraction stage, a first acceleration stage, and a further stage, wherein said further stage comprises a field free region in said Time of Flight mass analyser source region and the extraction stage performs orthogonal acceleration of ions into the filed free region.

2. The mass spectrometer of claim 1, wherein said Time of Flight mass analyser comprises a multi-pass Time of Flight mass analyser.

3. The mass spectrometer of claim 1, further comprising one or more collision, fragmentation or reaction cells disposed between the ion source and the Time of Flight mass analyser source region.

* * * * *